United States Patent [19]

Kristofferson et al.

[11] Patent Number: 4,650,617

[45] Date of Patent: Mar. 17, 1987

[54] SOLVENT-FREE PREPARATION OF GUN PROPELLANT FORMULATIONS

[75] Inventors: Clifford E. Kristofferson, North Ogden; Donald G. Fisher, Tremonton; Frank H. Bell, Logan; William F. Wagner, Brigham City, all of Utah

[73] Assignee: Morton Thiokol Inc., Chicago, Ill.

[21] Appl. No.: 748,889

[22] Filed: Jun. 26, 1985

[51] Int. Cl.[4] ..... C06B 45/10; C06B 21/00

[52] U.S. Cl. ..... 264/3.3; 149/19.4; 149/19.92

[58] Field of Search ..... 264/3 B; 149/19.4, 19.92

[56] References Cited

U.S. PATENT DOCUMENTS

| | | | |
|---|---|---|---|
| 3,888,707 | 6/1975 | Rothstein | 149/19.4 |
| 3,943,209 | 3/1976 | LoPresti et al. | 264/3 B |
| 4,002,514 | 1/1977 | Plomer et al. | 149/19.4 |
| 4,091,729 | 5/1978 | Bell et al. | 149/19.4 |
| 4,263,070 | 4/1981 | Price et al. | 149/92 |
| 4,456,493 | 6/1984 | Barnes et al. | 149/19.4 |
| 4,462,848 | 7/1984 | Elrick | 149/19.92 |

FOREIGN PATENT DOCUMENTS

| | | | |
|---|---|---|---|
| 3010052 | 9/1981 | Fed. Rep. of Germany | 264/3 B |

*Primary Examiner*—Edward A. Miller

*Attorney, Agent, or Firm*—Wayne E. Nacker; Gerald K. White

[57] ABSTRACT

A solventless method for the preparation and storage of uncured low vulnerability ammunition propellant (LOVA) includes blending from about 60 to 80 weight percent of either HMX or RDX oxidizer having a weight mean diameter from 1.0 to 14 microns with a polyurethane binder A cure effecting amount of cure catalyst may also be included. These ingredients are blended at a temperature below about 110° F., deaired, and optionally stored at low temperatures at a pre-cured condition, extruded and subsequently cured. The products produced thereby have uniquely low burning rates as well as uniquely low burning rate exponents.

10 Claims, No Drawings

SOLVENT-FREE PREPARATION OF GUN PROPELLANT FORMULATIONS

BACKGROUND OF THE INVENTION

The U.S. Government has a paid-License in this invention and the right in limited circumstances to require the patent owner to license others on reasonable terms as provided by the terms of contract DAAD05-76-C-0758 awarded by the Department of the Army.

CROSS REFERENCE TO OTHER APPLICATION

This application is related in subject matter to concurrently filed application Ser. No. 748,922, filed 6/26/85, invented by Clifford E. Kristofferson, Donald G. Fisher, and Frank H. Bell and entitled "Solid Composite Bi-Nitramine Propellant and Method of Making Same." Said application Ser. No. 748,922, filed 6/26/85 is a continuation-in-part of application Ser. No. 731,440, filed May 6, 1985, and also entitled "Solid Composite Bi-Nitramine Propellant and Method of Making Same."

FIELD OF THE INVENTION

The invention relates to gun propellant preparations. More particularly the invention relates to a solventless procedure for the mixing of propellants for utilization in ammunition having a low vulnerability to undesired detonation. The invention also relates to storing propellants in an uncured state preparatory to making a finished extruded propellant grain.

DESCRIPTION OF RELEVANT ART

A continuing objective in the design of ammunition, particularly for military use is to provide ammunition that is energetic when used, but which displays low vulnerability to heat, flame, impact, friction, and chemical action. This is especially important in confined quarters such as tanks, ships, submarines, and the like. This low vulnerability ammunition is known by the acronym LOVA.

During the preparation of propellant compositions, it has been common practice to utilize a volatile processing solvent. The procedures of this invention eliminate the use of processing solvent for the compositions taught. Solvents which have been used in the past include ketones such as acetone, petroleum ethers, methylene chloride, and amyl acetate. Deformation of cast charges due to propellant solvent evaporation is prevented by this invention. Uneven evaporation of solvent from the surface or from the core of the propellant is also eliminated, and unpredictable acceleration or deceleration caused by solvent burning is avoided. This solventless procedure results in lower costs and less process steps than the solvent procedure of the prior art.

SUMMARY OF THE INVENTION

This invention includes a solventless method of producing a cured solid extruded propellant grain product that may contain either HMX or RDX as an oxidizer component. Both products of the invention have low vulnerability characteristics and are further characterized by having uniquely low (for the type of oxidizer employed in the formulation) burning rates and uniquely low burning rate exponents.

The method of producing HMX-containing LOVA propellants generally comprises the procedure set forth below, first, producing an uncured solventless propellant formulation consisting essentially of from about 68 to 80% of crystalline solid HMX oxidizer having a weight mean diameter of from about 1 to 14 microns; from about 5 to 22% polyol; and from about 4 to 18% polyisocyanate curative for the polyol, all percentages being weight percent based upon total propellant formulation weight, by blending the polyol and the curative to form an uncured binder and then blending said oxidizer into the uncured binder while maintaining a blending temperature below 110° F. so as to avoid reacting the binder and oxidizer and thereby creating an extended pot life, then deairing the uncured solventless formulation, then extruding the uncured solventless formulation to produce an extrusion, and then curing the extrusion so as to obtain a low vulnerability propellant grain having a low burning rate on the order of 0.652 inches per second at 10,000 psi and 70° F., and a low burning rate exponent on the order of 1.014.

The HMX-containing material generally comprises a solid cured extruded propellant grain product having low vulnerability characteristics, a low burning rate on the order of 0.652 inches per second at 10,000 psi and 70° F. and a low burning rate exponent on the order to 1.014. The product is made from a solvent-free composition consisting essentially of from 68 to 80% of crystalline solid HMX oxidizer having a weight mean diameter of from about 1 to 14 microns; from about 5 to 22% polyol; and from about 4 to 18% polyisocyanate curative for the polyol, all percentages being weight percent based upon total propellant weight.

The method of producing RDX-containing LOVA propellants generally comprises first, producing an uncured solventless propellant formulation consisting essentially of from about 68 to 80% of crystalline solid RDX oxidizer having a weight mean diameter of from about 1 to 14 microns; from about 5 to 22% polyol; and from about 4 to 18% polyisocyanate curative for the polyol, all percentages being weight percent based upon total propellant formulation weight, by blending the polyol and the curative to form an uncured binder and then blending the oxidizer into the uncured binder while maintaining a blending temperature below 110° F. so as to avoid reacting the binder and oxidizer and thereby creating an extended pot life, then deairing the uncured solventless formulation, then extruding the uncured solventless formulation to produce an extrusion, and then curing the extrusion so as to obtain a low vulnerability propellant grain having a low burning rate on the order of 0.714 inches per second at 10,000 psi and 70° F., and a low burning rate exponent on the order of 0.939.

The RDX-containing material generally comprises a solid cured extruded propellant grain product having low vulnerability characteristics, a low burning rate on the order of 0.714 inches per second at 10,000 psi and 70° F. and a low burning rate exponent on the order to 0.939. The product is made from a solvent-free composition consisting essentially of from 68 to 80% of crystalline solid RDX oxidizer having a weight mean diameter of from about 1 to 14 microns; from about 5 to 22% polyol; and from about 4 to 18% polyisocyanate curative for the polyol, all percentages being weight percent based upon total propellant weight.

DESCRIPTION OF THE PREFERRED EMBODIMENT

A method for preparing a propellant formulation is disclosed. The formulation itself includes an oxidizer, and a binder. When the propellant is cured the binder serves as a matrix for the oxidizer. This oxidizer-binder matrix is generally termed, the propellant.

Suitable oxidiers for LOVA ammunition are cyclotetramethylene tetranitramine (HMX) or cyclotrimethylene trinitramine (RDX).

For the compositions taught in the Examples, it is preferred that either oxidizer have a weight mean diameter of from about 2.3 to 2.8 microns because of the particularly beneficial burn characteristics provided by oxidizer particles size. However, size parameters can be adjusted to suit the needs of the propellant formulator and generally oxidizer having a weight mean diameter of from about 1.0 to 14 is acceptable.

Bimodal, trimodal, and polymodal oxidizers may be used. However, unimodal oxidizers provide satisfactory results. Thus the necessity of experimenting with various modalities is obviated. Generally, it is desirable to include as much oxidizer as possible in the propellant composition in order to maximize thrust. Due to the increase in vicosity of the uncured propellant as the amount of oxidizer increases, as a practical matter, no more than about 80 weight percent oxidizer may be incorporated; generally about 75 weight percent oxidizer will be incorporated. As a practical matter, RDX contains up to 10 weight percent HMX as an impurity and HMX contains up to 2 weight percent RDX as an impurity. However, other than as an impurity, mixtures of the oxidizers are not contemplated in this invention.

Preferably, a polyurethane binder is utilized that is the reaction product of a polyisocyanate and at least one polyol. In a preferred embodiment two polyols are utilized. One polyol is the diol Pluronic L-35. Pluronic L-35 is the trademark of the Wyandotte Chemical Company for a diol which is the polyoxyalkylene derivative of propylene glycol. The other polyol is the triol trimethylol propane which is also known as TMP.

Other suitable diols include, but are not limited to, hydroxyterminated polybutadiene such as R-45, a trademark of Arco, Inc., for a hydroxyterminated polybutadiene, and R-18, a Hooker Chemical Company, Inc., trademark for a diol. Other diols may be utilized. The most preferred diols are highly fluid and readily wet the solid oxidizer.

Other suitable diols include, but are not limited to ethylene oxide glycidol, LHT 112, a very fluid glycol, polycaprolactone-260, a trademark of Union Carbide for a waxy solid caprolactone, and like reactants.

The preferred polyisocyanate is isophorone diisocyanate (also known as IPDI). Other suitable diisocyanates include, but are not limited to, toluene diisocyanate, hexane diisocyanate; and the like. Tri and higher functional isocyanate may also be used.

In curing the above composition, a cure catalyst is preferably utilized. A metal oxide cure catalyst such as titanyl acetyl acetonate ( $TiO(AA)_2$) is preferred. Other cure catalysts which may be utlized include dibutyl tin diacetate, dibutylin dilaurate, ferric acetyl acetonate, and other reasonable catalysts. When a cure catalyst is utilized a cure effective amount is about 0.0125 weight percent. That percentage can be adjusted.

In addition to the above components, the composition may include as optional ingredients, those ingredients used by those who practice this art to achieve certain propellant properties. Such optional ingredients include, but are not limited to, oxamide coolant, fire retardant phosphorous compounds, and stiffeners such as CAB-O-SIL, a trademark of the Cabot Corporation for fumed silica. Generally, these optional ingredients are kept to a minimum so as not to detract from the energetic nature of the propellant.

Plasticizers such as nitroglycerin and the like may be optionally present in the composition of the invention. However, metallic fuels such as aluminum should not be present in amounts greater than about 1 weight percent so as to preclude scoring of gun barrels when gun propellants are employed.

In a preferred embodiment a diol, e.g. Pluronic L-35, is used as a chain extender and a triol, e.g. TMP, is utilized as a cross linker.

In practice, the chain extender and the cross linker are mixed together and blended until all the cross linker is dissolved. Generally, blending and dissolving are better achieved at elevated temperatures. For Pluronic L-35 and TMP, a blending temperature of 145° F.±10° F. is preferred because it optimizes blending while maintaining temperatures sufficiently low to avoid undesired chemical activity.

After the cross linker has been dissolved, the resultant polyol blend is cooled preferably to a temperature of from about 80°-100° F. Then a curative, e.g. IPDI, and a catalyst, e.g. $TiO(AA_2)$, are added while mixing within the 80°-100° F. temperature range. Because of the chain extension reaction between the polyisocyanate and the diol and the potential for extensive cross linking with the triol, positive efforts must be taken to control the temperature in order for reaction to occur in a desirably controlled manner. Generally a temperature below 100° F. is preferred.

To this mixture finely divided oxidizer, e.g. HMX or RDX, is added. Generally mixing occurs at a temperature that is sufficiently high to keep the viscosity low enough to facilitate efficient oxidizer wetting of the binder that is formed from the above diol-triol-isocyanate. But the temperature is kept sufficiently low to avoid chemically reacting the oxidizer with the binder and thereby creating an extended pot life. For the IPDI-TMP-Pluronic L-35 binder just described a temperature less than about 110° F. is desired during oxidizer addition.

Less than about 110° F. is also desired for mixing these specific components because this temperature is also sufficiently low to avoid complete cross linking of the binder. Complete cross linking or curing of the binder is to be avoided prior to the extrusion of the uncured propellant into a desired propellant grain.

In order to facilitate blending at this reduced temperature of less than about 110° F., the oxidizer may be added in stages.

The mixture is then packaged and cooled to a cure arresting temperature; preferably a temperature of about −50° F. or lower.

When a propellant is to be produced, the cure arrested mixture is thawed and extruded at normal extrusion temperatures. Normal extrusion temperatures are those temperatures at which extrusion can be reasonably practiced. Preferably, those temperatures fall within the range of 120°-160° F. Most preferably extrusion temperatures of from 130°-150° F. will be used for the compositions embodied in the Examples.

After extrusion, cross linking will be completed at a cure temperature. Preferably a temperature of about 150° F. will be utilized. However, since cure is to a certain extent both time and temperature dependent, lower cure temperatures can be utilized. Although cure could be accomplished at room temperature, as a practical matter, temperatures falling within the range 130°-150° are preferred because this provide a more practical cure rate.

It should be pointed out that cure arresting cooling is an optional step. It is feasible to prepare, extrude, and cure the propellant composition without using the cure arresting procedure.

The above prepared blend is containerized, as a whole or in portions, in polyethylene film bags or other suitable containers, and stored at −50° F.

When extrusion is desired, the package mix is thawed, the mix removed from the container and then extruded to form a propellant grain. It is believed that storage at the cure arresting temperature of −50° F. is suitable to maintain pot life for up to 2 months before thawing and subsequent extrusion. High, cure arresting temperatures are available and can be determined without undue experimentation. But generally temperatures below −40° F. are preferred and temperatures below −50° F. are most preferred because the lower temperatures tend to provide a more complete cure arrest and longer pot life.

The following Examples provide a few of the possible embodiments of this invention. The use of the term percent in relation to a specific indicates percent by weight of that specific component based on the weight of the entire propellant composition.

EXAMPLE 1

| Item Material | Composition (wt. %) |
|---|---|
| 1. Polyol, Pluronic L-35 | 11.7 |
| 2. Trimethylolpropane (TMP) | 3.13 |
| 3. Isophorone diisocyanate (IPDI) | 10.10 |
| 4. HMX (cyclotetramethylene tetranitramine) | 75.00 |
| Size may be 2.3-2.8 micron WMD (100%) or a ratio of 2.8 micron WMD HMX and Class E HMX may be used. | 100.00 |
| 5. TiO $(AA)_2$ as catalyst | 0.0125 |

The following procedure was used:

Propellant mixing was accomplished in a heavy duty vertical mixer having blades utilizing a planetary motion. Particular attention was paid to time and temperature throughout the process.

The Pluronic L-35 polyol and the trimethylolpropane (TMP) were mixed and preheated at 145° F.±10° F. until all TMP solids were dissolved. The mixture was then cooled to fall within the range 90°-100° F. The Pluronic L-35 and TMP had added to them curative IPDI and catalyst $TiO(AA)_2$. Mixing occured for 10 minutes at slow speed while maintaining a temperature below 100° F.

Finely divided HMX explosive was added in four portions. First, one half the total amount of allocated HMX was added to the above mixture, mixing for five minutes at slow speed while temperature was controlled to less than 110° F.

Then an additional 20% of the total allocated HMX was added and mixing continued for 15 minutes at slow speed while the temperature was maintained at less than 110° F.

An additional 20% of the total allocated HMX was added to the above mixture and mixing was continued for 15 minutes at slow speed. The temperature was again maintained at less than 110° F. during mixing.

The remaining 5% of the total HMX was added and the mixture mixed for 15 minutes at slow speed under vaccum. (0.5 inch Hg absolute) while the temperature was maintained at less than 110° F.

The resulting uncured propellant mixture was divided and packaged in polyethylene film bags.

The bags of propellant mixture were frozen at −50° F. and stored for two months.

At the end of two months, the uncured propellant mixture was thawed and extruded.

The extruded propellant was cured, and found to have the following properties:

Physical Properties:

Density: 0.064 lb/in$^3$ at 77° F.

Ballistic Properties for unimodal HMX:

Cured Strand $R_b$ at 10,000 psi and 70° F.: 0.652 in/sec

Burning Rate Exponent: 1.014

The uncured propellant mixture prepared from the above components was stored at a temperature of −50° F. for two months. At the end of two months, the mixture temperature was elevated sufficiently to allow extrusion and then the mixture was extruded to form a propellant grain. The propellant grain was cured and after curing had the following properties:

Physical Properties:

Density: 0.0615 16/in$^3$ at 77° F.

Balistic Properties for unimodal RDX:

Cured Strand $R_b$ at 10,000 psi and 70° F.: 0.714 in/sec

Burning Rate Exponent: 0.939

We claim:

1. A method of producing a solid extruded propellant grain having a low burning rate and a low burning rate exponent, the method comprising:

a. producing an uncured solventless propellant formulation consisting essentially of from about 68% to 80% of crystalline solid oxidizer selected from the group consisting of HMX and RDX and having a weight mean diameter of from about 1 to 14 microns; from about 5 to 22% of a polyol composition that is fluid and readily wets said solid oxidizer, whereby said polyol composition is blendable with said solid oxidizer without either melting said polyol composition or dissolving said polyol composition in a solvent; and from about 4 to 18% polyisocyanate curative for said polyol composition, all percentages being weight percent based upon total propellant formulation weight, by blending said polyol composition and said curative to form an uncured binder and then blending said oxidizer into said uncured binder while maintaining a blending temperature below 110° F. so as to avoid reacting said binder and said oxidizer and thereby creating an extended pot life;

b. deairing said uncured solventless formulation;

c. cooling said uncured solventless formulation to below about −40° F. and then raising the temperature;

d. extruding said uncured solventless formulation to produce an extrusion; and e. curing said extrusion so as to obtain a low vulnerability propellant grain.

2. The method of claim 1, wherein: an effective amount of a cure catalyst is incorporated into said uncured solventless formulation.

3. The method of claim 1, wherein: said uncured solventless formulation in cooled to at least −50° F.

4. A method according to claim 1 wherein said polyol composition comprises a greater amount of a highly fluid diol and a lesser amount of a non-fluid triol dissolved therein, said diol functioning as a chain extender and said triol functioning as a cross-linker.

5. A method of producing a solid extruded propellant grain having a low burning rate on the order of 0.714 inches per second at 10,000 psi and 70° F., and a low burning rate exponent on the order of 0.939, the method comprising:

a. producing an uncured solventless propellant formulation consisting essentially of from about 68 to 80% of crystalline solid RDX oxidizer having a weight mean diameter of from about 1 to 14 microns; from about 5 to 22% of a polyol composition comprising a greater amount of a polyoxyalkylene derivative of propylene glycol and a lesser amount of trimethylol propane dissolved therein; and from about 4 to 18% polyisocyanate curative for said polyol composition, all percentages being weight percent based upon total propellant formulation weight, by blending said polyol composition and said curative to form an uncured binder and then blending said oxidizer into said uncured binder while maintaining a blending temperature below 110° F. so as to avoid reacting said binder and said oxidizer and thereby creating an extended pot life;

b. deairing said uncured solventless formulation;

c. cooling said uncured solventless formulation to below about −40° F. and then raising the temperature;

d. extruding said uncured solventless formulation to produce an extrusion; and e. curing said extrusion so as to obtain a low vulnerability propellant grain.

6. The method of claim 5, wherein: an effective amount of a cure catalyst is incorporated into said uncured solventless formulation.

7. The method of claim 5, wherein: said uncured solventless formulation is cooled to at least −50° F.

8. A method of producing a solid extruded propellant grain having a low burning rate on the order of 0.652 inches per second at 10,000 psi and 70° F., and a low burning rate exponent on the order of 1.014, comprising:

a. producing an uncured solventless propellant formulation consisting essentially of from about 68 to 80% of crystalline solid HMX oxidizer having a weight mean diameter of from about 1 to 14 microns; from about 5 to 22% of a polyol composition comprising a greater amount of a polyoxyalkylene derivative of propylene glycol and a lesser amount of trimethylol propane dissolved therein; and from about 4 to 18% polyisocyanate curative for said polyol composition, all percentages being weight percent based upon total propellant formulation weight, by blending said polyol composition and said curative to form an uncured binder and then blending said oxidizer into said uncured binder while maintaining a blending temperature below 110° F. so as to avoid reacting said binder and oxidizer and thereby creating an extended pot life;

b. deairing said uncured solventless formulation;

c. cooling said uncured solventless formulation to below about −40° F. and then raising the temperature;

d. extruding said uncured solventless formulation to produce an extrusion; and e. curing said extrusion so as to obtain a low vulnerability propellant grain.

9. The method of claim 8, wherin an effective amount of a cure catalyst is incorporated into said uncured solventless formulation.

10. The method of claim 8, wherein said uncured solventless formulation is cooled to at least about −50° F.

* * * * *